United States Patent [19]

Dropczynski

[11] Patent Number: 4,974,786

[45] Date of Patent: Dec. 4, 1990

[54] METHOD AND DEVICE FOR WINDING WEBS OF MATERIAL ESPECIALLY WEBS OF PAPER OR CARDBOARD

[75] Inventor: Hartmut Dropczynski, Dormagen, Fed. Rep. of Germany

[73] Assignee: Jagenberg Aktiengesellschaft, Dusseldorf, Fed. Rep. of Germany

[21] Appl. No.: 334,648

[22] Filed: Apr. 6, 1989

[30] Foreign Application Priority Data

Apr. 9, 1988 [DE] Fed. Rep. of Germany ..... 3811871

[51] Int. Cl.[5] ..... B65H 19/30

[52] U.S. Cl. ..... 242/066; 242/65

[58] Field of Search ..... 242/56 R, 65, 66

[56] References Cited

U.S. PATENT DOCUMENTS

| | | | |
|---|---|---|---|
| 4,345,722 | 8/1982 | Kuhn | 242/66 X |
| 4,370,193 | 1/1983 | Knauthe | 242/66 X |
| 4,456,190 | 6/1984 | Karttunen et al. | 242/56 R |
| 4,485,979 | 12/1984 | Dropczynski | 242/56 R |
| 4,516,735 | 5/1985 | Snygg | 242/66 X |
| 4,601,441 | 7/1986 | Oinonen et al. | 242/56 R |
| 4,726,533 | 2/1988 | Dropczynski | 242/66 X |
| 4,789,109 | 12/1988 | Kyttsonen et al. | 242/66 X |

FOREIGN PATENT DOCUMENTS

| | | |
|---|---|---|
| 2948877 | 2/1982 | Fed. Rep. of Germany . |
| 3151256 | 10/1983 | Fed. Rep. of Germany . |
| 3527377 | 2/1987 | Fed. Rep. of Germany . |

*Primary Examiner*—Stuart S. Levy

*Assistant Examiner*—Steven M. duBois

*Attorney, Agent, or Firm*—Sprung Horn Kramer & Woods

[57] ABSTRACT

A method of and device for winding webs of material, especially webs of paper or cardboard, on cores. In the method, the web is wound on cores in a bed created by two drums and the full reels are ejected from the bed above one drum by an arm that swings around the other. Wound reels with a short diameter are compressed between the ejection surface on the ejection arm and the drum that the reel is being ejected over and are lifted out of the bed by a rotation of the drum. The device has a mechanism for ejecting full reels that swings forward toward the bed created by two drums and has an ejection arm with an ejection surface that extends more or less radially toward the drum that the reel swings around. The ejection surface in one embodiment extends as far as the drum that the reel swings around and, once is has swung forward, its upper demarcation will extend into the vicinity of the adjacent drum. Another embodiment of the device also has a combination reel-ejection and core-insertion mechanism that has an ejection arm and a core-insertion structure, whereby the ejection surface on the arm terminates at a distance from the drum and the core-insertion structure releases the cores through the space between the ejection surface and the drum. The ejection surface can, when the ejection-and-insertion mechanism is at rest, be moved or extended toward the drum that the reel swings around.

10 Claims, 3 Drawing Sheets

METHOD AND DEVICE FOR WINDING WEBS OF MATERIAL ESPECIALLY WEBS OF PAPER OR CARDBOARD

BACKGROUND OF THE INVENTION

The invention concerns a method of winding webs of material, especially webs of paper or cardboard, on cores, whereby the web is wound on cores in a bed created by two drums and the full reels are ejected from the bed above one drum by an arm that swings around the other.

The known reel-ejection and core-insertion mechanisms employed in drum-type winders change reels by ejecting the full reel from the bed and inserting a fresh core. A generic method and a drum-type winder is known from German Patent No. 3 151 256. It has a reel-ejection mechanism that swings around one drum and toward the bed and has an arm with an ejection surface that extends more or less radially in relation to the drum. The reel-ejection mechanism and the core-insertion mechanism are mechanically separate, and each swings separately toward the bed.

German Patent No. 2 948 877 describes a drum-type winder with a combination ejection-and-insertion mechanism. It has a reel-ejection arm and a core-insertion structure. The ejection surface on the arm terminates at a distance from the drum, and the core-insertion structure releases the core in the space between the ejection surface and the drum. The ejection-and-insertion mechanism consists of the arm and of tensioning tongs. Both the arm and the tongs are secured to a common lever and can accordingly swing together around one drum and into the bed. The ejection surface on the arm extends more or less radially in relation to the drum and terminates at a distance from it that is longer than the drum's diameter, allowing the tongs, which are integrated into the arm, to intercept the core in the space between the ejection surface and the drum and insert it in the bed.

Another drum-type winder of the same genus is described in German No. OS 3 527 377. The ejection-and-insertion mechanism in this winder also has a retainer between the tongs' jaws that allows the core to be lowered without being rotated onto the drums once it has swung over the bed.

The drawback to all these known drum-type winders is that the arm can only eject reels that have a minimum diameter because they must be forced up as far as the apical line of the first drum. In combination ejection-and-insertion mechanisms, the minimum diameter is more than twice as long as the distance between the bottom end of the ejection surface on the arm and the drum around which the core swings that is necessary to the function of the insertion mechanism. Furthermore, if an attempt is made to eject a reel with too short a diameter, the reel-insertion mechanism can always be forced against the reel and damaged.

It can occur in practice for many reasons that, just after winding has begun, a complete set of reels is to be ejected and removed from the bed. If some of the reels are not yet at their minimum diameter, they must be lifted out of the bed manually. Since the reels will be fairly heavy even by then, this situation constitutes a source of considerable stress on the operators.

OBJECTS OF THE INVENTION

One object of the invention is accordingly to improve such a method to the extent that even reels with a short diameter can be removed from the bed.

Another object of the invention is to improve such a drum-type winder to the extent that even reels with a short diameter can be removed from the bed.

The first object is attained in accordance with the invention in that wound reels with a short diameter are compressed between the ejection surface on the ejection arm and the drum that the reel is being ejected over and are lifted out of the bed by a rotation of the drum.

The second object is attained in accordance with the invention either in that the ejection surface extends as far as the drum that the reel swings around and, once it has swung forward, its upper demarcation will extend into the vicinity of the adjacent drum, or in that the ejection surface can, when the ejection-and-insertion mechanism is at rest, be moved or extended toward the drum that the reel swings around.

The ejection surface in the former embodiment can yield resiliently in the direction of either swinging motion and come to rest against the reel in the bed. The same embodiment can have an ejection mechanism that is elastically coupled to the mechanism that swings it.

The ejection surface in the latter embodiment can be moved or extended as far as the drum that the reel swings around and, once it has swung forward, its upper demarcation can extend into the vicinity of the adjacent drum. This embodiment can have levers that pivot around an axis paralleling that of the drum, that a core-insertion mechanism is secured to, and that have the ejection arm articulated to their free ends by means of a setting mechanism such that the arms can swing toward the drum. The same embodiment can have a sheet-metal extension articulated to the end of the ejection surface that faces the drum that the reel swings around. The embodiment can alternately have a sheet-metal extension that slides along the ejection surface toward the drum.

Either embodiment of the winder can have an ejection-and-insertion mechanism that is elastically coupled to the mechanism that swings it.

When the ejection surface extends as far as the drum that the reel swings around or when the ejection surface can be moved or extended as far as the drum that the reel swings around and, once it has been swung forward, its upper demarcation will extend into the vicinity of the adjacent drum, the reels that have a short diameter and must be removed from the bed can be compressed between the ejection surface on the ejection arm and the drum that the reel is being ejected over and can be lifted out of the bed by a rotation of the drum up to the apical line of the drum by allowing the compressed reel to roll along the ejection surface.

When the ejection surface can, when the ejection-and-insertion mechanism is at rest, be moved or extended toward the drum, the ejection-and-insertion mechanism can be adjusted for reels with a short diameter and the reel-insertion structures will be protected from damage.

The elastically applicable and/or elastically coupled ejection surface ensures continuous contact between the ejection surface, the compressed reel, and the drum at approximately constant pressure.

The sheet-metal extension and the ejection-and-insertion mechanism that is elastically coupled to the mechanism that swings it represent advantageous improvements in the design.

BRIEF DESCRIPTION OF THE DRAWINGS

The invention will now be described in greater detail with reference to the drawings, which are schematic and wherein.

DETAILED DESCRIPTION OF THE INVENTION

Figure 1:
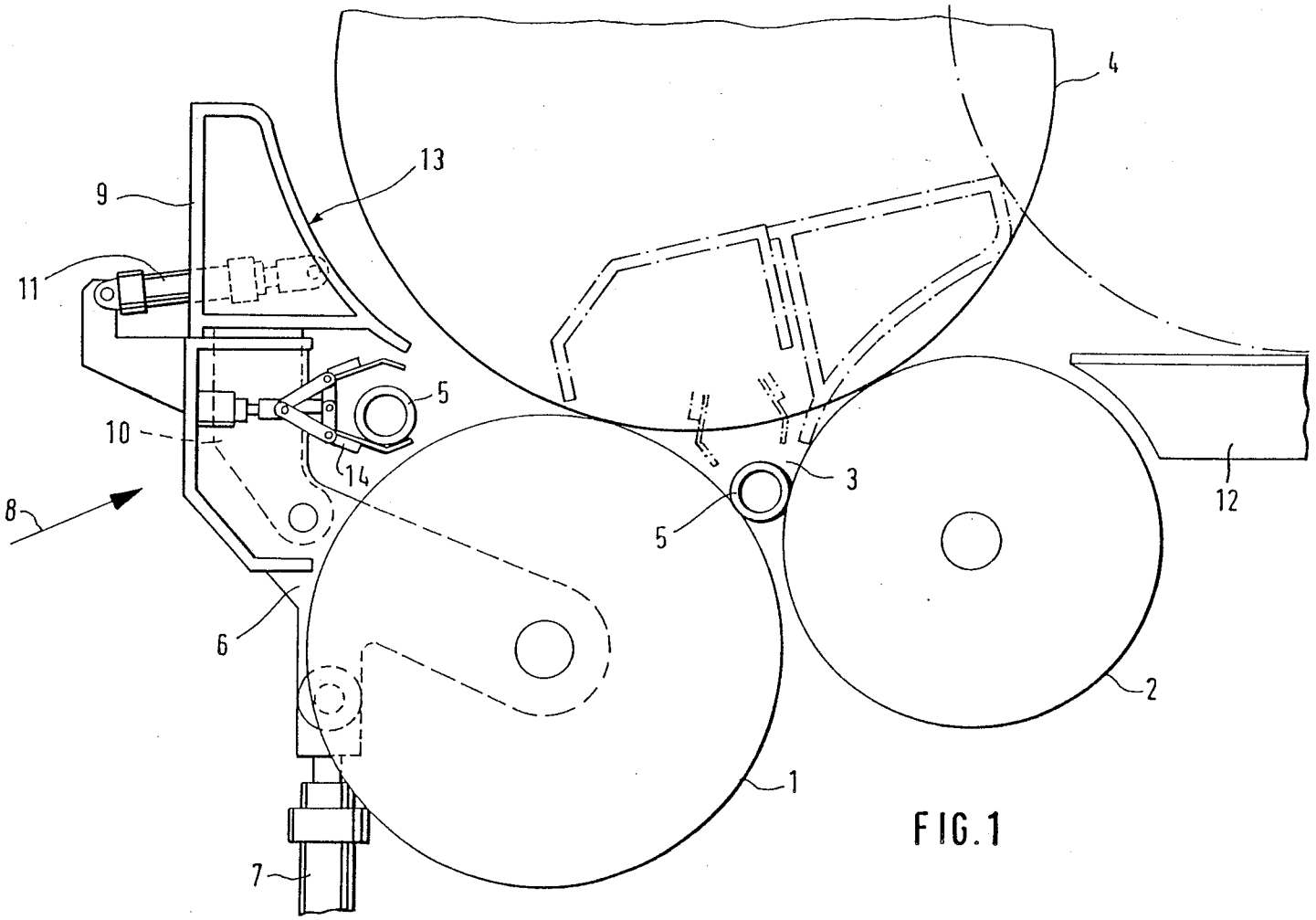
FIGS. 1 and 2 illustrate a drum-type winder in accordance with the invention wherein the ejection surface on the ejection arm can swing toward the drum and FIG. 3 illustrates a drum-type winder with an ejection arm with an ejection surface that can be extended by a sheet-metal extension.

The drum-type winder has two drums 1 and 2 that create between them a bed 3, wherein reels 4 are positioned while they are being wound against the drums. A web of material, preferably a web of paper or cardboard, has been slit into subsidiary webs and is introduced from below, wrapped around drum 1, into the bed 3 between drums 1 and 2. Since two-drum winders of this type are in themselves known, the design will not be discussed in detail.

Articulated to each end of drum 1 is a lever 6 that pivots on the same axis that the drum rotates around. The pivoting motion is produced by an adjusting mechanism, an articulated piston-and-cylinder unit 7 in the present case. Since piston-and-cylinder unit 7 can yield slightly in either direction of pivot, lever 6 is elastically coupled within certain limits. The free end of each lever 6 bends toward bed 3 and supports a reel-ejection and core-insertion mechanism 8 that will be described in greater detail hereinafter.

Figure 2:
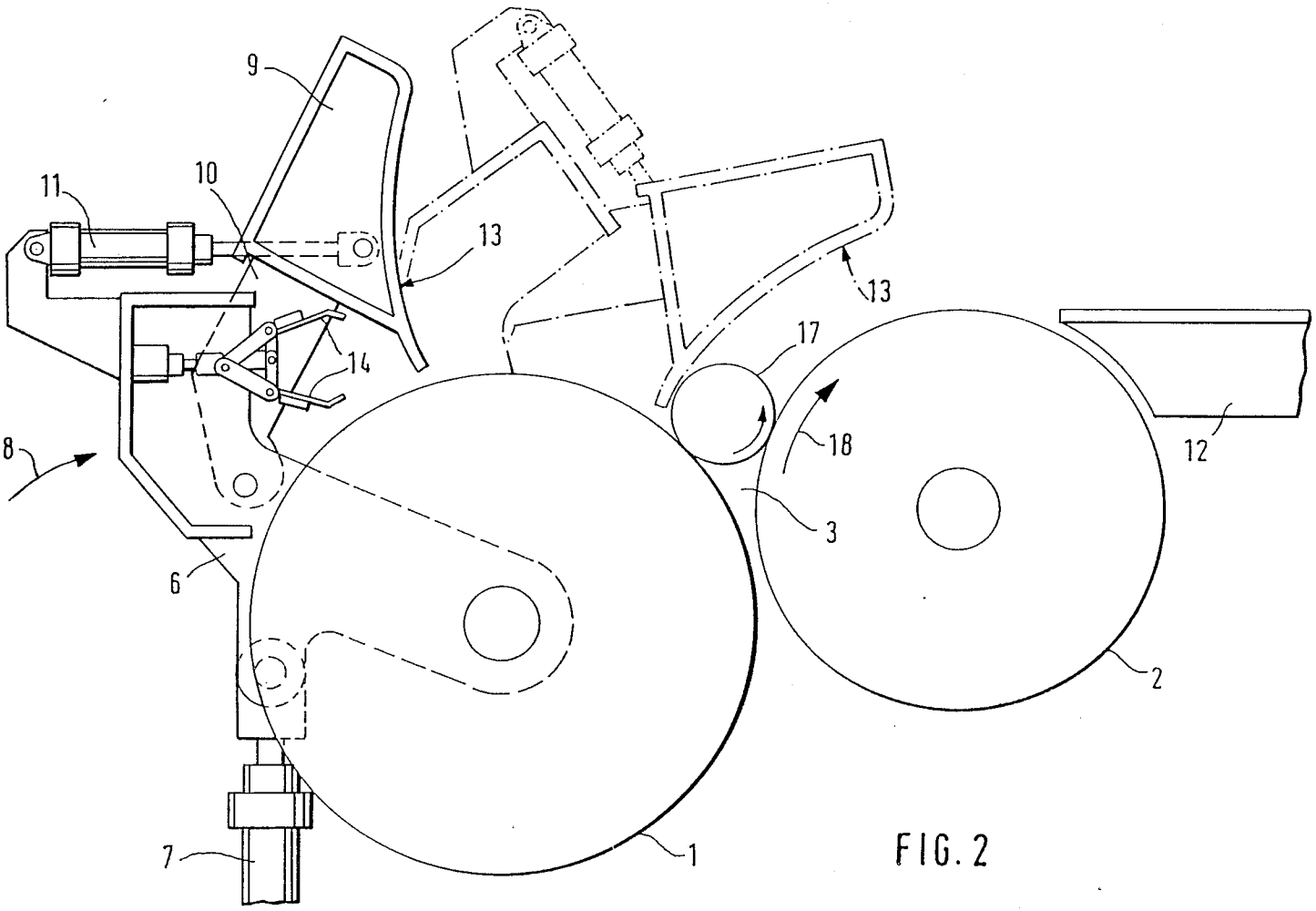
Figure 3:
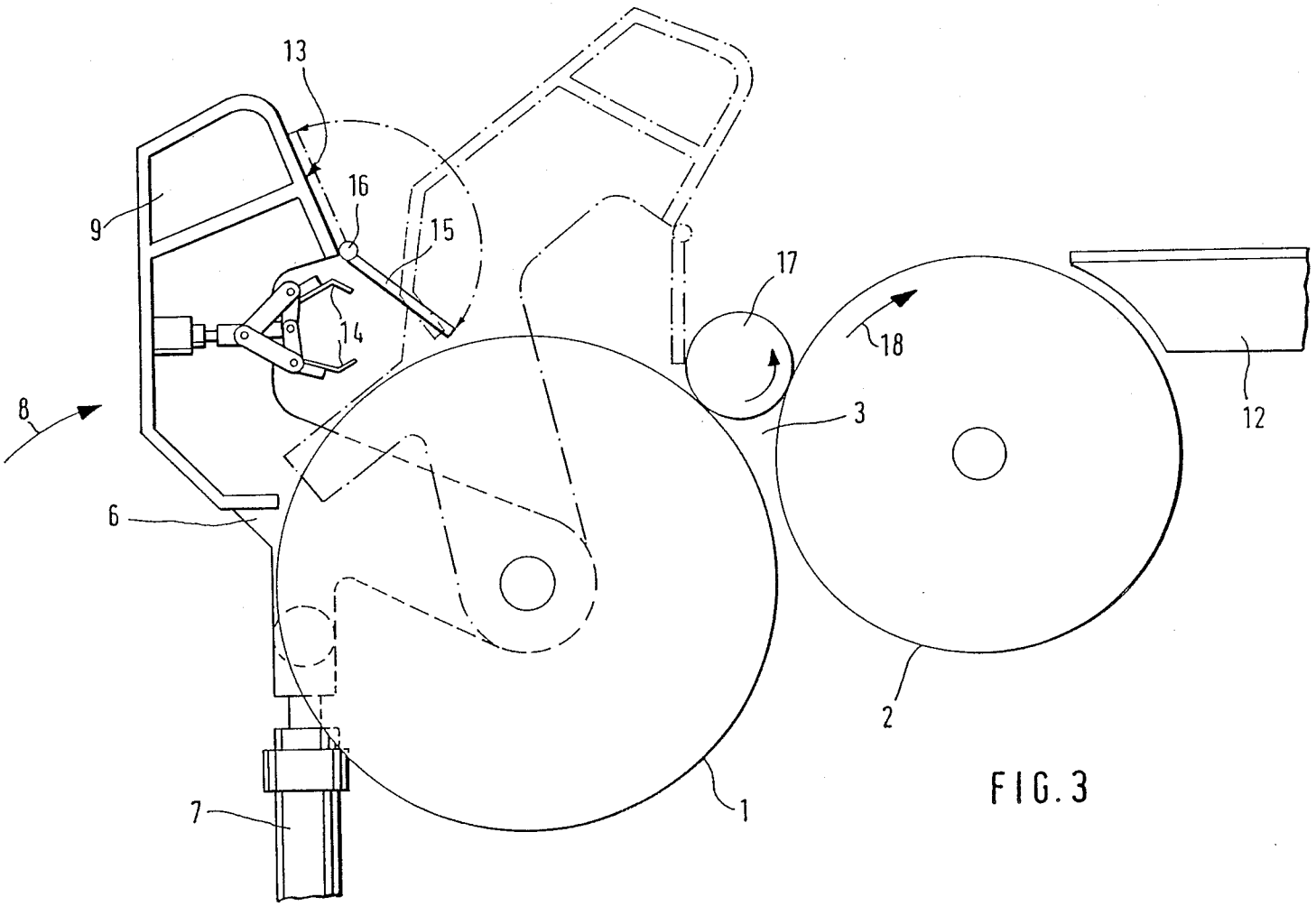

Secured to the bent section of lever 6 is an ejection arm 9 that extends along the width of the winder. The ejection arm 9 in the embodiments illustrated in FIGS. 1 and 2 is secured to additional arms 10 articulated to levers 6 that can be pivoted by means of another piston-and-cylinder unit 11 toward drum 1 and in relation to levers 6. The ejection arm 9 in the embodiment illustrated in FIG. 3 is rigidly fastened to levers 6.

The function of ejection arm 9 is to eject a finished reel 4 over drum 2 and onto an ascending and descending platform 12. The ejection surface 13 on arm 9 faces drum 2, is shaped more or less to match the circumference of a reel 4, and extends more or less radially in relation to drum 1. Once it has swung forward (into the position represented by the dot-and-dash lines in FIGS. 1 through 3), ejection surface 13 extends into the vicinity of the apical line of drum 2.

Reel-ejection and core-insertion mechanism 8 also has tensioning tongs 14 for inserting fresh cores 5 into bed 3. The jaws on tongs 14 are between arm 9 and drum 1. Tongs 14 are secured to the bent section of lever 6. The structure of tongs of this type is known and described for example in German No. OS 3 527 377 and in German Patent No. 2 948 877.

The ejection surface 13 in the embodiment illustrated in FIGS. 1 and 2 extends far enough into the vicinity of tongs 14 to end, when arms 10 have been pivoted forward (FIG. 2), just in front of drum 1. When arms 10 have been pivoted back and are in alignment with the bent section of lever 6, the distance between the lower end of ejection surface 13 and drum 1 is sufficient to allow cores 5 to be freely inserted in bed 3 through the intermediate space.

Articulated to the end of the ejection surface 13 that faces the drum 1 in the embodiment illustrated in FIG. 3 is a sheet-metal extension 15 that extends along the width of the winder and pivots on an axis 16 that parallels the axis of the drum. Extension 15 can pivot far enough back to rest against ejection surface 13 and accordingly make the necessary space between that surface and drum 1 accessible for inserting cores 5. Extension 15 can also be pivoted down to just in front of drum 1 in order to extend ejection surface 13 as far as the drum.

It is also possible to use a sheet-metal extension that slides parallel to ejection surface 13 instead of a pivoting sheet-metal extension 15.

How the just described two-drum winder operates will now be described.

In normal operation, when empty cores 5 are inserted into and full reels 4 ejected out of bed 3, arms 10 are pivoted back (FIG. 1) or sheet-metal extension 15 is pivoted back against ejection surface 13 (FIG. 3). There is accordingly enough space between ejection surface 13 and drum 1 to allow tongs 14 to operate unimpeded.

Before the reels are changed, empty and waiting cores 5 are intercepted by and accommodated in tongs 14. To change reels, arm 9 swings toward bed 3 and forces the full reels 4 out of the bed and onto platform 12. While the arm is swinging forward, the tongs 14 with the empty cores 5 move toward bed 3, where the tongs open and deposit the cores on drums 1 and 2. Once reel-ejection and core-insertion mechanism 8 has swung back and a new initial web section has been secured to the cores, drums 1 and 2 begin turning in one direction to initiate the winding process.

If reels 17, that have a diameter so short that reel-ejection and core-insertion mechanism 8 cannot operate as previously described herein, must be removed from bed 3, either the waiting arms 10 will swing toward bed 3 (FIG. 2) or sheet-metal extension 15 will pivot down toward drum 1, creating in either case a surface that extends all the way to drum 1. The levers 6 will then pivot along with piston-and-cylinder unit 7 toward bed 3 until ejection surface 13 (FIG. 2) or sheet-metal extension 15 (FIG. 3) rests against reels 17 and forces them against drum 2. Drum 2 then moves clockwise in the direction indicated by arrow 18, forcing reels 17 up between drum 2 and ejection surface 13 or extension 15 as far as the apical line of drum 2, where it can roll on its own onto platform 12. Since piston-and-cylinder unit 7 allows reel-ejection and core-insertion mechanism 8 and hence ejection surface 13 to yield in both directions of the pivoting motion, the contact between drum 2, reels 17, and ejection surface 13 will be maintained constant at an approximately constant pressure.

It is understood that the specification and examples are illustrative but not limitative of the present invention and that other embodiments within the spirit and scope of the invention will suggest themselves to those skilled in the art.

What is claimed is:

1. In a method of winding webs of material on cores and ejecting the fully wound cores, wherein two drums form a core bed, a core is disposed in the bed, the drums are rotated to wind a web on the core in the core bed and a wound core is ejected from the bed above one drum by swinging an arm having an ejection surface around the other drum, the improvement wherein a wound core having a relatively small diameter is ejected by compressing the wound core with a relatively small diameter between the ejection surface on the arm and said one drum over which the wound core is being ejected and lifting the wound core out of the core bed by rotating said one drum.

2. In a two drum-type winder for winding webs of material on cores, including first and second winding drums defining a core bed for receiving a core to be wound and means for ejecting a wound core from the core bed over the second drum comprising an ejection arm pivotable around the first drum into an ejecting position and having means forming an ejection surface that extends generally radially of the first drum, the improvement wherein the means forming the ejection surface includes means for extending the ejecting surface to the first drum and to a surface of the second drum when the ejection arm pivots into the ejecting position to compress a wound core between the ejecting surface and a surface of the second drum.

3. A drum-type winder according to claim 1, wherein the means forming the ejection surface is resiliently yieldable in directions of movement of the ejection arm.

4. A drum-type winder according to claim 3, wherein the means for ejecting includes means elastically coupled to the ejection arm for pivoting same.

5. In a two drum-type winder for winding webs of material on cores, including first and second winding drums defining a core bed for receiving a core to be would and means for ejecting a wound core from the core bed over the second drum comprising an ejection arm pivotable around the first drum between a rest position and an ejecting position and having means forming an ejection surface that extends generally radially of the first drum core-insertion means receptive of an empty core between the ejection surface and the first drum when the ejection arm is in the rest position for inserting the empty core into the core bed when the ejection arm is in the ejecting position, the improvement wherein the means forming the ejection surface includes means for extending the ejection surface toward the first drum after the empty core has been received.

6. A drum-type winder according to claim 5, wherein means for extending the ejection surface extends same to a surface of the second drum when the ejection arm is in the ejecting position to compress a wound core between the ejection surface and the second drum.

7. A drum-type winder according to claim 5, wherein the means for extending comprises levers pivotable around an axis paralleling the first drum to swing the ejection arm toward the first drum.

8. A drum-type winder according to claim 5, wherein the means for extending comprises a sheet-metal extension articulated to one end of the ejection surface facing the first drum.

9. A drum-type winder according to claim 5, wherein the means for extending comprises a sheet-metal extension slidable along the ejection surface toward the first drum.

10. A drum-type winder according to claim 6, further comprising means elastically coupled to the ejecting means and inserting means for pivoting same.

* * * * *

UNITED STATES PATENT AND TRADEMARK OFFICE

CERTIFICATE OF CORRECTION

PATENT NO. : 4,974,786

DATED : December 4, 1990

INVENTOR(S) : Hartmut Dropczynski

It is certified that error appears in the above-identified patent and that said Letters Patent is hereby corrected as shown below:

Col. 5, line 19 After " claim " delete " 1 " and substitute -- 2 --

Col. 5, line 28 Delete " would " and substitute -- wound --

Signed and Sealed this

Nineteenth Day of January, 1993

*Attest:*

DOUGLAS B. COMER

*Attesting Officer*

*Acting Commissioner of Patents and Trademarks*